US007236928B2

(12) United States Patent
Lashkari et al.

(10) Patent No.: US 7,236,928 B2
(45) Date of Patent: Jun. 26, 2007

(54) JOINT OPTIMIZATION OF SPEECH EXCITATION AND FILTER PARAMETERS

(75) Inventors: Khosrow Lashkari, Freemont, CA (US); Toshio Miki, Cupertino, CA (US)

(73) Assignee: NTT DoCoMo, Inc., Tokyo (JP)

( * ) Notice: Subject to any disclaimer, the term of this patent is extended or adjusted under 35 U.S.C. 154(b) by 820 days.

(21) Appl. No.: 10/023,826

(22) Filed: Dec. 19, 2001

(65) Prior Publication Data

US 2003/0115048 A1 Jun. 19, 2003

(51) Int. Cl.
*G10L 19/08* (2006.01)

(52) U.S. Cl. ..... 704/223

(58) Field of Classification Search ..... None
See application file for complete search history.

(56) References Cited

U.S. PATENT DOCUMENTS

| | | | | |
|---|---|---|---|---|
| 5,293,449 | A | 3/1994 | Tzeng | |
| 5,664,055 | A * | 9/1997 | Kroon | 707/223 |
| 5,699,482 | A * | 12/1997 | Adoul et al. | 704/219 |
| 5,732,389 | A * | 3/1998 | Kroon et al. | 704/223 |
| 5,754,976 | A * | 5/1998 | Adoul et al. | 704/223 |
| 6,449,590 | B1 * | 9/2002 | Gao | 704/219 |
| 6,662,154 | B2 * | 12/2003 | Mittal et al. | 704/219 |
| 2003/0014263 | A1 * | 1/2003 | Ca et al. | 704/500 |

FOREIGN PATENT DOCUMENTS

JP 07-005899 1/1995

OTHER PUBLICATIONS

Yining Chen, Penghao Wang, Jia Liu and Runsheng Liu, A New Algorithm for Parameter Re-optimization in Multi-Pulse Excitation LP Synthesizer, The 2000 IEEE Asia-Pacific Converence, Dec. 4-6, 2000, pp. 560-563.*

Reigelsberger and Krishnamurthy, Glottal Source Estimation: Methods of Applying the LF-Model to Inverse Filtering, IEEE International Conf. on Acoustics, Speech and Signal Processing, vol. 2, Apr. 27-30, 1993, pp. 542-545.*

Lashkari and Miki, Optimization of the CELP Model in the LSP Domain, Euro Speech, Sep. 2003, 4 pages.*

Manfred R. Schroeder and Bishnu S. Atal, "Code-Excited Linear Prediction (CELP): High-Quality Speech At Very Low Bit Rates," Mar. 26-29, 1985, pp. 937 through 940.

Alan V. McCree and Thomas P. Barnwell III, "A Mixed Excitation LPC Vocoder Model for Low Bit Rate Speech Coding," Jul. 1995, pp. 242 through 250.

B.S. Atal and Suzanne L. Hanauer, "Speech Analysis and Synthesis by Linear Prediction of the Speech Wave," Apr. 1971, pp. 637 through 655.

Bishnu S. Atal and Joel R. Remde, "A New Model of LPC Excitation For Producing Natural-Sounding Speech At Low Bit Rates," 1982, pp. 614 through 617.

G. Fant, "The Acoustics Speech," 1959, pp. 17 through 30.

S. Maitra et al., "Speech Coding Using Forward and Backward Prediction," Nineteenth Asilomar Conference on Circuits, Systems and Computers, Nov. 6, 1985, pp. 213-217, XP010277830, IEEE, Pacific Grove, California, U.S.A.

* cited by examiner

*Primary Examiner*—David D. Knepper
(74) *Attorney, Agent, or Firm*—Blakely, Sokoloff, Taylor & Zafman LLP

(57) ABSTRACT

An efficient optimization algorithm is provided for multi-pulse speech coding systems. The efficient algorithm performs computations using the contribution of the non-zero pulses of the excitation function and not the zeroes of the excitation function. Accordingly, efficiency improvements of 87% to 99% are possible with the efficient optimization algorithm.

25 Claims, 7 Drawing Sheets

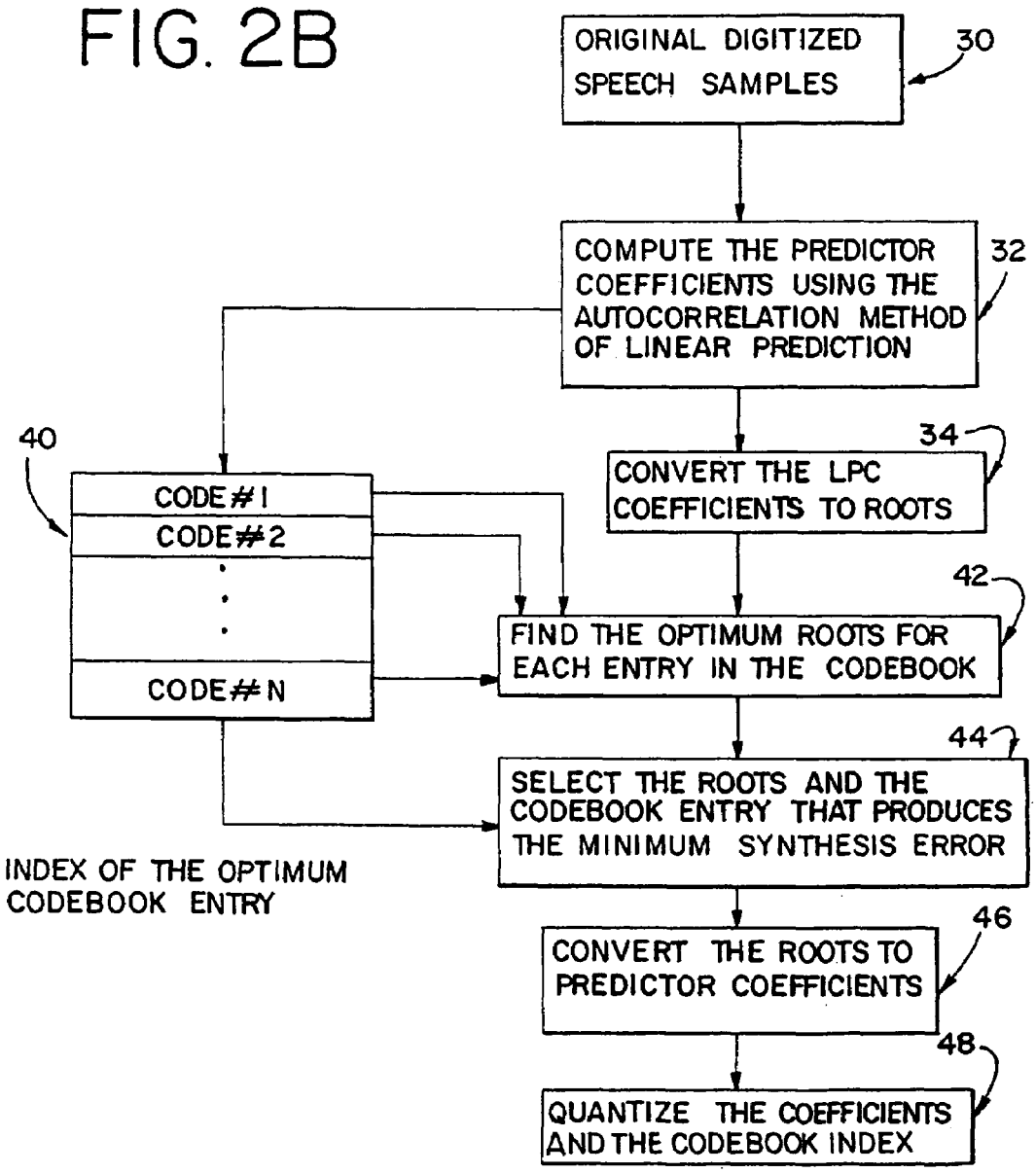
FIG. 2B
ORIGINAL DIGITIZED SPEECH SAMPLES
30
COMPUTE THE PREDICTOR COEFFICIENTS USING THE AUTOCORRELATION METHOD OF LINEAR PREDICTION
32
40
CODE#1
CODE#2
CODE#N
34
CONVERT THE LPC COEFFICIENTS TO ROOTS
42
FIND THE OPTIMUM ROOTS FOR EACH ENTRY IN THE CODEBOOK
44
SELECT THE ROOTS AND THE CODEBOOK ENTRY THAT PRODUCES THE MINIMUM SYNTHESIS ERROR
INDEX OF THE OPTIMUM CODEBOOK ENTRY
46
CONVERT THE ROOTS TO PREDICTOR COEFFICIENTS
48
QUANTIZE THE COEFFICIENTS AND THE CODEBOOK INDEX

JOINT OPTIMIZATION OF SPEECH EXCITATION AND FILTER PARAMETERS

BACKGROUND

The present invention relates generally to speech encoding, and more particularly, to an efficient encoder that employs sparse excitation pulses.

Speech compression is a well known technology for encoding speech into digital data for transmission to a receiver which then reproduces the speech. The digitally encoded speech data can also be stored in a variety of digital media between encoding and later decoding (i.e., reproduction) of the speech.

Speech coding systems differ from other analog and digital encoding systems that directly sample an acoustic sound at high bit rates and transmit the raw sampled data to the receiver. Direct sampling systems usually produce a high quality reproduction of the original acoustic sound and is typically preferred when quality reproduction is especially important. Common examples where direct sampling systems are usually used include music phonographs and cassette tapes (analog) and music compact discs and DVDs (digital). One disadvantage of direct sampling systems, however, is the large bandwidth required for transmission of the data and the large memory required for storage of the data. Thus, for example, in a typical encoding system which transmits raw speech data sampled from an original acoustic sound, a data rate as high as 128,000 bits per second is often required.

In contrast, speech coding systems use a mathematical model of human speech production. The fundamental techniques of speech modeling are known in the art and are described in B. S. Atal and Suzanne L. Hanauer, *Speech Analysis and Synthesis by Linear Prediction of the Speech Wave*, The Journal of the Acoustical Society of America, 637–55 (vol. 50 1971). The model of human speech production used in speech coding systems is usually referred to as the source-filter model. Generally, this model includes an excitation signal that represents air flow produced by the vocal folds, and a synthesis filter that represents the vocal tract (i.e., the glottis, mouth, tongue, nasal cavities and lips). Therefore, the excitation signal acts as an input signal to the synthesis filter similar to the way the vocal folds produce air flow to the vocal tract. The synthesis filter then alters the excitation signal to represent the way the vocal tract manipulates the air flow from the vocal folds. Thus, the resulting synthesized speech signal becomes an approximate representation of the original speech.

One advantage of speech coding systems is that the bandwidth needed to transmit a digitized form of the original speech can be greatly reduced compared to direct sampling systems. Thus, by comparison, whereas direct sampling systems transmit raw acoustic data to describe the original sound, speech coding systems transmit only a limited amount of control data needed to recreate the mathematical speech model. As a result, a typical speech synthesis system can reduce the bandwidth needed to transmit speech to between about 2,400 to 8,000 bits per second.

One problem with speech coding systems, however, is that the quality of the reproduced speech is sometimes relatively poor compared to direct sampling systems. Most speech coding systems provide sufficient quality for the receiver to accurately perceive the content of the original speech. However, in some speech coding systems, the reproduced speech is not transparent. That is, while the receiver can understand the words originally spoken, the quality of the speech may be poor or annoying. Thus, a speech coding system that provides a more accurate speech production model is desirable.

One solution that has been recognized for improving the quality of speech coding systems is described in U.S. patent application Ser. No. 09/800,071 to Lashkari et al., hereby incorporated by reference. Briefly stated, this solution involves minimizing a synthesis error between an original speech sample and a synthesized speech sample. One difficulty that was discovered in that speech coding system, however, is the highly nonlinear nature of the synthesis error, which made the problem mathematically ill-behaved. This difficulty was overcome by solving the problem using the roots of the synthesis filter polynomial instead of coefficients of the polynomial. Accordingly, a root optimization algorithm is described therein for finding the roots of the synthesis filter polynomial.

One improvement upon above-mentioned solution is described in U.S. Pat. No. 6,859,775 to Lashkari et al. This improvement describes an improved gradient search algorithm that may be used with iterative root searching algorithms. Briefly stated, the improved gradient search algorithm recalculates the gradient vector at each iteration of the optimization algorithm to take into account the variations of the decomposition coefficients with respect to the roots. Thus, the improved gradient search algorithm provides a better set of roots compared to algorithms that assume the decomposition coefficients are constant during successive iterations.

One remaining problem with the optimization algorithm, however, is the large amount of computational power that is required to encode the original speech. As those in the art well know, a central processing unit ("CPU") or a digital signal processor ("DSP") must be used by speech coding systems to calculate the various mathematical formulas used to code the original speech. Oftentimes, when speech coding is performed by a mobile unit, such as a mobile phone, the CPU or DSP is powered by an onboard battery. Thus, the computational capacity available for encoding speech is usually limited by the speed of the CPU or DSP or the capacity of the battery. Although this problem is common in all speech coding systems, it is especially significant in systems that use optimization algorithms. Typically, optimization algorithms provide higher quality speech by including extra mathematical computations in addition to the standard encoding algorithms. However, inefficient optimization algorithms require more expensive, heavier and larger CPUs and DSPs which have greater computational capacity. Inefficient optimization algorithms also use more battery power, which results in shortened battery life. Therefore, an efficient optimization algorithm is desired for speech coding systems.

BRIEF SUMMARY

Accordingly, an efficient speech coding system is provided for optimizing the mathematical model of human speech production. The efficient encoder includes an improved optimization algorithm that takes into account the sparse nature of the multipulse excitation by performing the computations for the gradient vector only where the excitation pulses are non-zero. As a result, the improved algorithm significantly reduces the number of calculations required to optimize the synthesis filter. In one example, calculation efficiency is improved by approximately 87% to 99% without changing the quality of the encoded speech.

BRIEF DESCRIPTION OF SEVERAL VIEWS OF THE DRAWINGS

The invention, including its construction and method of operation, is illustrated more or less diagrammatically in the drawings, in which:

FIG. 2B is a flow chart of an alternative speech synthesis system using joint optimization of the model parameters and the excitation signal;

DESCRIPTION

Figure 1:
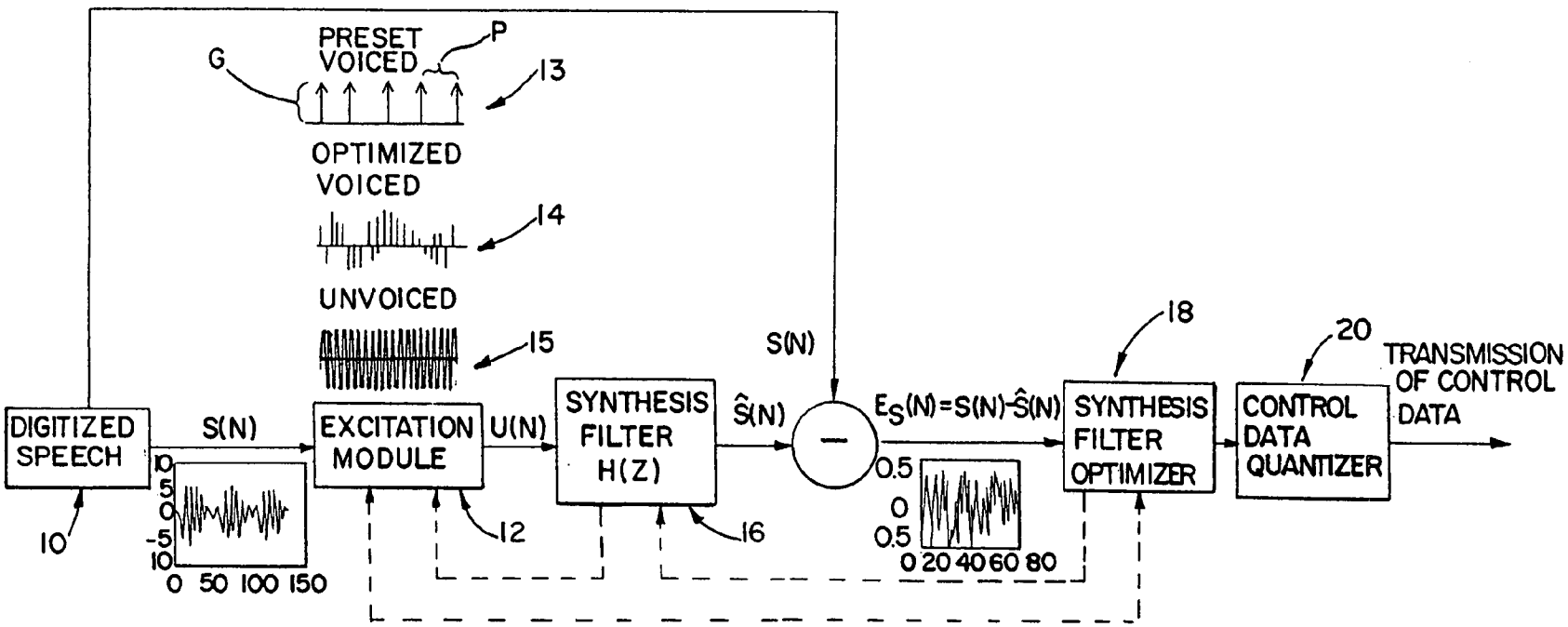
FIG. 1 is a block diagram of a speech analysis-by-synthesis system.

Referring now to the drawings, and particularly to FIG. 1, a speech coding system is provided that minimizes the synthesis error in order to more accurately model the original speech. In FIG. 1, an analysis-by-synthesis ("AbS") system is shown which is commonly referred to as a source-filter model. As is well known in the art, source-filter models are designed to mathematically model human speech production. Typically, the model assumes that the human sound-producing mechanisms that produce speech remain fixed, or unchanged, during successive short time intervals, or frames (e.g., 10 to 30 ms analysis frames). The model further assumes that the human sound producing mechanisms can change between successive intervals. The physical mechanisms modeled by this system include air pressure variations generated by the vocal folds, glottis, mouth, tongue, nasal cavities and lips. Thus, the speech decoder reproduces the model and recreates the original speech using only a small set of control data for each interval. Therefore, unlike conventional sound transmission systems, the raw sampled data of the original speech is not transmitted from the encoder to the decoder. As a result, the digitally encoded data that is actually transmitted or stored (i.e., the bandwidth, or the number of bits) is much less than those required by typical direct sampling systems.

Accordingly, FIG. 1 shows an original digitized speech 10 delivered to an excitation module 12. The excitation module 12 then analyzes each sample s(n) of the original speech and generates an excitation function u(n). The excitation function u(n) is typically a series of pulses that represent air bursts from the lungs which are released by the vocal folds to the vocal tract. Depending on the nature of the original speech sample s(n), the excitation function u(n) may be either a voiced 13, 14 or an unvoiced signal 15.

One way to improve the quality of reproduced speech in speech coding systems involves improving the accuracy of the voiced excitation function u(n). Traditionally, the excitation function u(n) has been treated as a series of pulses 13 with a fixed magnitude G and period P between the pitch pulses. As those in the art well know, the magnitude G and period P may vary between successive intervals. In contrast to the traditional fixed magnitude G and period P, it has previously been shown to the art that speech synthesis can be improved by optimizing the excitation function u(n) by varying the magnitude and spacing of the excitation pulses 14. This improvement is described in Bishnu S. Atal and Joel R. Remde, *A New Model of LPC Excitation For Producing Natural-Sounding Speech At Low Bit Rates*, IEEE International Conference On Acoustics, Speech, And Signal Processing 614–17 (1982). This optimization technique usually requires more intensive computing to encode the original speech s(n). However, in prior systems, this problem has not been a significant disadvantage since modern computers usually provide sufficient computing power for optimization 14 of the excitation function u(n). A greater problem with this improvement has been the additional bandwidth that is required to transmit data for the variable excitation pulses 14. One solution to this problem is a coding system that is described in Manfred R. Schroeder and Bishnu S. Atal, *Code-Excited Linear Prediction* (*CELP*): *High-Quality Speech At Very Low Bit Rates*, IEEE International Conference On Acoustics, Speech, And Signal Processing, 937–40 (1985). This solution involves categorizing a number of optimized excitation functions into a library of functions, or a codebook. The encoding excitation module 12 will then select an optimized excitation function from the codebook that produces a synthesized speech that most closely matches the original speech s(n). Next, a code that identifies the optimum codebook entry is transmitted to the decoder. When the decoder receives the transmitted code, the decoder then accesses a corresponding codebook to reproduce the selected optimal excitation function u(n).

The excitation module 12 can also generate an unvoiced 15 excitation function u(n). An unvoiced 15 excitation function u(n) is used when the speaker's vocal folds are open and turbulent air flow is produced through the vocal tract. Most excitation modules 12 model this state by generating an excitation function u(n) consisting of white noise 15 (i.e., a random signal) instead of pulses.

In one example of a typical speech coding system, an analysis frame of 10 ms may be used in conjunction with a sampling frequency of 8 kHz. Thus, in this example, 80 speech samples are taken and analyzed for each 10 ms frame. In standard linear predictive coding ("LPC") systems, the excitation module 12 usually produces one pulse for each analysis frame of voiced sound. By comparison, in code-excited linear prediction ("CELP") systems, the excitation module 12 will usually produce about ten pulses for each analysis frame of voiced speech. By further comparison, in mixed excitation linear prediction ("MELP") systems, the excitation module 12 generally produces one pulse for every speech sample, that is, eighty pulses per frame in the present example.

Next, the synthesis filter 16 models the vocal tract and its effect on the air flow from the vocal folds. Typically, the synthesis filter 16 uses a polynomial equation to represent the various shapes of the vocal tract. This technique can be visualized by imagining a multiple section hollow tube with several different diameters along the length of the tube. Accordingly, the synthesis filter 16 alters the characteristics of the excitation function u(n) similar to the way the vocal tract alters the air flow from the vocal folds, or in other words, like the variable diameter hollow tube example alters inflowing air.

According to Atal and Remde, supra., the synthesis filter 16 can be represented by the mathematical formula:

$$H(z)=G/A(z) \tag{1}$$

where G is a gain term representing the loudness of the voice. A(z) is a polynomial of order M and can be represented by the formula:

$$A(z) = 1 + \sum_{k=1}^{M} a_k z^{-k} \tag{2}$$

The order of the polynomial A(z) can vary depending on the particular application, but a 10th order polynomial is commonly used with an 8 kHz sampling rate. The relationship of the synthesized speech ŝ(n) to the excitation function u(n) as determined by the synthesis filter 16 can be defined by the formula:

$$\hat{s}(n) = Gu(n) - \sum_{k=1}^{M} a_k \hat{s}(n-k) \tag{3}$$

Conventionally, the coefficients $a_1 \ldots a_M$ of this polynomial are computed using a technique known in the art as linear predictive coding ("LPC"). LPC-based techniques compute the polynomial coefficients $a_1 \ldots a_M$ by minimizing the total prediction error $E_p$. Accordingly, the sample prediction error $e_p(n)$ is defined by the formula:

$$e_p(n) = s(n) + \sum_{k=1}^{M} a_k s(n-k) \tag{4}$$

The total prediction error $E_p$ is then defined by the formula:

$$E_p = \sum_{k=0}^{N-1} e_p^2(k) \tag{5}$$

where N is the length of the analysis frame expressed in number of samples. The polynomial coefficients $a_1 \ldots a_M$ can now be computed by minimizing the total prediction error $E_p$ using well known mathematical techniques.

One problem with the LPC technique of computing the polynomial coefficients $a_1 \ldots a_M$ is that only the total prediction error is minimized. Thus, the LPC technique does not minimize the error between the original speech s(n) and the synthesized speech ŝ(n). Accordingly, the sample synthesis error $e_s(n)$ can be defined by the formula:

$$e_s(n) = s(n) - \hat{s}(n) \tag{6}$$

The total synthesis error $E_s$ can then be defined by the formula:

$$E_s = \sum_{n=0}^{N-1} e_s^2(n) = \sum_{n=0}^{N-1} (s(n) - \hat{s}(n))^2 \tag{7}$$

where as before, N is the length of the analysis frame in number of samples. Like the total prediction error $E_p$ discussed above, the total synthesis error $E_s$ should be minimized to compute the optimum filter coefficients $a_1 \ldots a_M$. However, one difficulty with this technique is that the synthesized speech ŝ(n), as represented in formula (3), makes the total synthesis error $E_s$ a highly nonlinear function that is not generally well-behaved mathematically.

One solution to this mathematical difficulty is to minimize the total synthesis error $E_s$ using the roots of the polynomial A(z) instead of the coefficients $a_1 \ldots a_M$. Using roots instead of coefficients for optimization also provides control over the stability of the synthesis filter 16. Accordingly, assuming that h(n) is the impulse response of the synthesis filter 16, the synthesized speech ŝ(n) is now defined by the formula:

$$\hat{s}(n) = h(n) * u(n) = \sum_{k=0}^{n} h(k)u(n-k) \tag{8}$$

where * is the convolution operator. In this formula, it is also assumed that the excitation function u(n) is zero outside of the interval 0 to N−1.

In LPC and multipulse encoders, the excitation function u(n) is relatively sparse. That is, non-zero pulses occur at only a few samples in the entire analysis frame, with most samples in the analysis frame having no pulses. For LPC encoders, as few as one pulse per frame may exist, while multipulse encoders may have as few as 10 pulses per frame. Accordingly, $N_p$ may be defined as the number of excitation pulses in the analysis frame, and p(k) may be defined as the pulse positions within the frame. Thus, the excitation function u(n) can be expressed by the formulas:

$$u(p(k)) \neq 0 \text{ for } k=1,2 \ldots N_p \tag{9a}$$

$$u(n)=0 \text{ for } n \neq p(k) \tag{9b}$$

Hence, the excitation function u(n) for a given analysis frame includes $N_p$ pulses at locations defined by p(k) with the amplitudes defined by u(p(k)).

By substituting formulas (9a) and (9b) into formula (8), the synthesized speech ŝ(n) can now be expressed by the formula:

$$\hat{s}(n) = h(n) * u(n) = \sum_{k=0}^{F(n)} h(n - p(k))u(p(k)) \tag{10}$$

where F(n) is the number of pulses up to and including sample n in the analysis frame. Accordingly, the function F(n) satisfies the following relationships:

$$p(F(n)) \leqq n \tag{11a}$$

$$F(n) \leqq N_p \tag{11b}$$

This relationship for F(n) is preferred because it guarantees that (n−p(k)) will be non-negative.

From the foregoing, it can now be shown that formula (8) requires n multiplications and n additions in order to compute the synthesized speech at sample n. Accordingly, the total number of multiplications and additions $N_T$ that are required for a given frame of length N is given by the formula:

$$N_T = N(N+1)/2 \tag{12}$$

Thus, the resulting number of computations required is given by a quadratic function defined by the length of the analysis frame. Therefore, in the aforementioned example, the total number $N_T$ of computations required by formula (8) may be as many as 3,240 (i.e., 80(80+1)/2) for a 10 ms frame.

On the other hand, it can be shown that the maximum number $N'_T$ of computations required to compute the synthesized speech using formula (10) can be closely approximated by the formula:

$$N'_T = N_p N \tag{13}$$

where $N_p$ is the total number of pulses in the frame. Formula (13) represents the maximum number of computations that may be required assuming that the pulses are nonuniformly distributed. If pulses are uniformly distributed in the analysis frame, the total number $N''_T$ of computations required by formula 10 is given by the formula:

$$N''_T = N_p N/2 \tag{14}$$

Therefore, using the aforementioned example again, the total number $N''_T$ of computations required by formula (10) may be as few as 400 (i.e., 10(80)/2) for a RPE (Regular Pulse Excitation) multipulse encoder. By comparison, formula (10) may require as few as 40 computations (i.e., 1(80)/2) for an LPC encoder.

One advantage of the improved optimization algorithm can now be appreciated. The computation of the synthesized speech ŝ(n) using the convolution of the impulse response h(n) and the excitation function u(n) requires far fewer calculations than previously required. Thus, whereas about 3,240 computations were previously required, only 400 computations are now required for RPE multipulse encoders and only 40 computations for LPC encoders. This improvement results in about an 87% reduction in computational load for RPE encoders and about a 99% reduction for LPC encoders.

Using the roots of A(z), the polynomial can now be expressed by the formula:

$$A(z) = (1-\lambda_1 z^{-1}) \ldots (1-\lambda_M z^{-1}) \tag{15}$$

where $\lambda_1 \ldots \lambda_M$ represent the roots of the polynomial A(z). These roots may be either real or complex. Thus, in the preferred 10th order polynomial, A(z) will have 10 different roots.

Using parallel decomposition, the synthesis filter transfer function H(z) is now represented in terms of the roots by the formula:

$$H(z) = 1/A(z) = \sum_{i=1}^{M} b_i/(1-\lambda_i z^{-1}) \tag{16}$$

(the gain term G is omitted from this and the remaining formulas for simplicity). The decomposition coefficients $b_i$ are then calculated by the residue method for polynomials, thus providing the formula:

$$b_i = \prod_{j=1, j\neq i}^{M} (1/(1-\lambda_j \lambda_i^{-1})) \tag{17}$$

The impulse response h(n) can also be represented in terms of the roots by the formula:

$$h(n) = \sum_{i=1}^{M} b_i (\lambda_i)^n \tag{18}$$

Next, by combining formula (18) with formula (8), the synthesized speech ŝ(n) can be expressed by the formula:

$$\hat{s}(n) = \sum_{k=0}^{n} h(k)u(n-k) = \sum_{k=0}^{n} u(n-k) \sum_{i=1}^{M} b_i (\lambda_i)^k \tag{19}$$

By substituting formulas (9a) and (9b) into formula (19), the synthesized speech ŝ(n) can now be efficiently computed by the formula:

$$\hat{s}(n) = \sum_{k=0}^{n} h(k)u(n-k) = \sum_{k=1}^{F(n)} u(p(k)) \sum_{i=1}^{M} b_i (\lambda_i)^{n-p(k)} \tag{20}$$

where F(n) is defined by the relationship in formula (11). As previously described, formula (20) is about 87% more efficient than formula (19) for multipulse encoders and is about 99% more efficient for LPC encoders.

The total synthesis error $E_s$ can be minimized using polynomial roots and a gradient search algorithm by substituting formula (20) into formula (7). A number of optimization algorithms may be used to minimize the total synthesis error $E_s$. However, one possible algorithm is an iterative gradient search algorithm. Accordingly, denoting the root vector at the j-th iteration as $\Lambda^{(j)}$, the root vector can be expressed by the formula:

$$\Lambda^{(j)} = [\lambda_1^{(j)} \ldots \lambda_r^{(j)} \ldots \lambda_M^{(j)}]^T \tag{21}$$

where $\lambda_r^{(j)}$ is the value of the r-th root at the j-th iteration and T is the transpose operator. The search begins with the LPC solution as the starting point, which is expressed by the formula:

$$\Lambda^{(0)} = [\lambda_1^{(0)} \ldots \lambda_r^{(0)} \ldots \lambda_M^{(0)}]^T \tag{22}$$

To compute $\Lambda^{(0)}$, the LPC coefficients $a_1 \ldots a_M$ are converted to the corresponding roots $\lambda_1^{(0)} \ldots \lambda_M^{(0)}$ using a standard root finding algorithm.

Next, the roots at subsequent iterations can be computed using the formula:

$$\Lambda^{(j+1)} = \Lambda^{(j)} + \mu \nabla_j E_s \tag{23}$$

where μ is the step size and $\nabla_j E_s$ is the gradient of the synthesis error $E_s$ relative to the roots at iteraton j. The step size μ can be either fixed for each iteration, or alternatively, it can be variable and adjusted for each iteration. Using formula (7), the synthesis error gradient vector $\nabla_j E_s$ can now be calculated by the formula:

$$\nabla_j E_s = \sum_{k=1}^{N-1} (s(k) - \hat{s}(k)) \nabla_j \hat{s}(k) \tag{24}$$

Formula (24) demonstrates that the synthesis error gradient vector $\nabla_j E_s$ can be calculated using the gradient vectors of the synthesized speech samples $\hat{s}(k)$. Accordingly, the synthesized speech gradient vector $\nabla_j \hat{s}(k)$ can be defined by the formula:

$$\nabla_j \hat{s}(k)=[\partial\hat{s}(k)/\partial\lambda_1^{(j)} \ldots \partial\hat{s}(k)/\partial\lambda_r^{(j)} \ldots \partial\hat{s}(k)/\partial\lambda_M^{(j)}] \tag{25}$$

where $\partial\hat{s}(k)/\partial\lambda_r^{(j)}$ is the partial derivative of $\hat{s}(k)$ at iteration j with respect to the r-th root. Using formula (19), the partial derivatives $\partial\hat{s}(k)/\partial\lambda_r^{(j)}$ can be computed by the formula:

$$\partial\hat{s}(k)/\partial\lambda_r^{(j)} = b_r\sum_{m=1}^{k} mu(k-m)(\lambda_r^{(j)})^{(m-1)} \quad k \geq 1 \tag{26}$$

where $\partial\hat{s}(0)/\partial\lambda_r^{(j)}$ is always zero.

By substituting formulas (9a) and (9b) into formula (26), the synthesized speech $\hat{s}(n)$ can now be expressed by the formula:

$$\partial\hat{s}(k)/\partial\lambda_r^{(j)} = b_r\sum_{m=1}^{F(k)} (k-p(m))u(p(m))(\lambda_r^{(j)})^{(k-p(m)-1)} \tag{27}$$

where F(n) is defined by the relationship in formula (11). Like formulas (10) and (20), the computation of formula (27) will require far fewer calculations compared to formula (26).

The synthesis error gradient vector $\nabla_j E_s$ is now calculated by substituting formula (27) into formula (25) and formula (25) into formula (24). The updated root vector $\Lambda^{(j+1)}$ at the next iteration can then be calculated by substituting the result of formula (24) into formula (23). After the root vector $\Lambda^{(j)}$ is recalculated, the decomposition coefficients $b_i$ are updated prior to the next iteration using formula (17). A detailed description of one algorithm for updating the decomposition coefficients is described in U.S. Pat. No. 6,859,775 to Lashkari et al. The iterations of the gradient search algorithm are repeated until either the step-size becomes smaller than a predefined value $\mu_{min}$, a predetermined number of iterations are completed, or the roots are resolved within a predetermined distance from the unit circle.

Although control data for the optimal synthesis polynomial A(z) can be transmitted in a number of different formats, it is preferable to convert the roots found by the optimization technique described above back into polynomial coefficients $a_1 \ldots a_M$. The conversion can be performed by well known mathematical techniques. This conversion allows the optimized synthesis polynomial A(z) to be transmitted in the same format as existing speech coding systems, thus promoting compatibility with current standards.

Now that the synthesis model has been completely determined, the control data for the model is quantized into digital data for transmission or storage. Many different industry standards exist for quantization. However, in one example, the control data that is quantized includes ten synthesis filter coefficients $a_1 \ldots a_{10}$, one gain value G for the magnitude of the excitation pulses, one pitch period value P for the frequency of the excitation pulses, and one indicator for a voiced 13 or unvoiced 15 excitation function u(n). As is apparent, this example does not include an optimized excitation pulse 14, which could be included with some additional control data. Accordingly, the described example requires the transmission of thirteen different variables at the end of each speech frame. Commonly, in CELP encoders the control data are quantized into a total of 80 bits. Thus, according to this example, the synthesized speech $\hat{s}(n)$, including optimization, can be transmitted within a bandwidth of 8,000 bits/s (80 bits/frame÷0.010 s/frame).

As shown in both FIGS. 1 and 2, the order of operations can be changed depending on the accuracy desired and the computing resources available. Thus, in the embodiment described above, the excitation function u(n) was first determined to be a preset series of pulses 13 for voiced speech or an unvoiced signal 15. Second, the synthesis filter polynomial A(z) was determined using conventional techniques, such as the LPC method. Third, the synthesis polynomial A(z) was optimized.

Figure 2A:
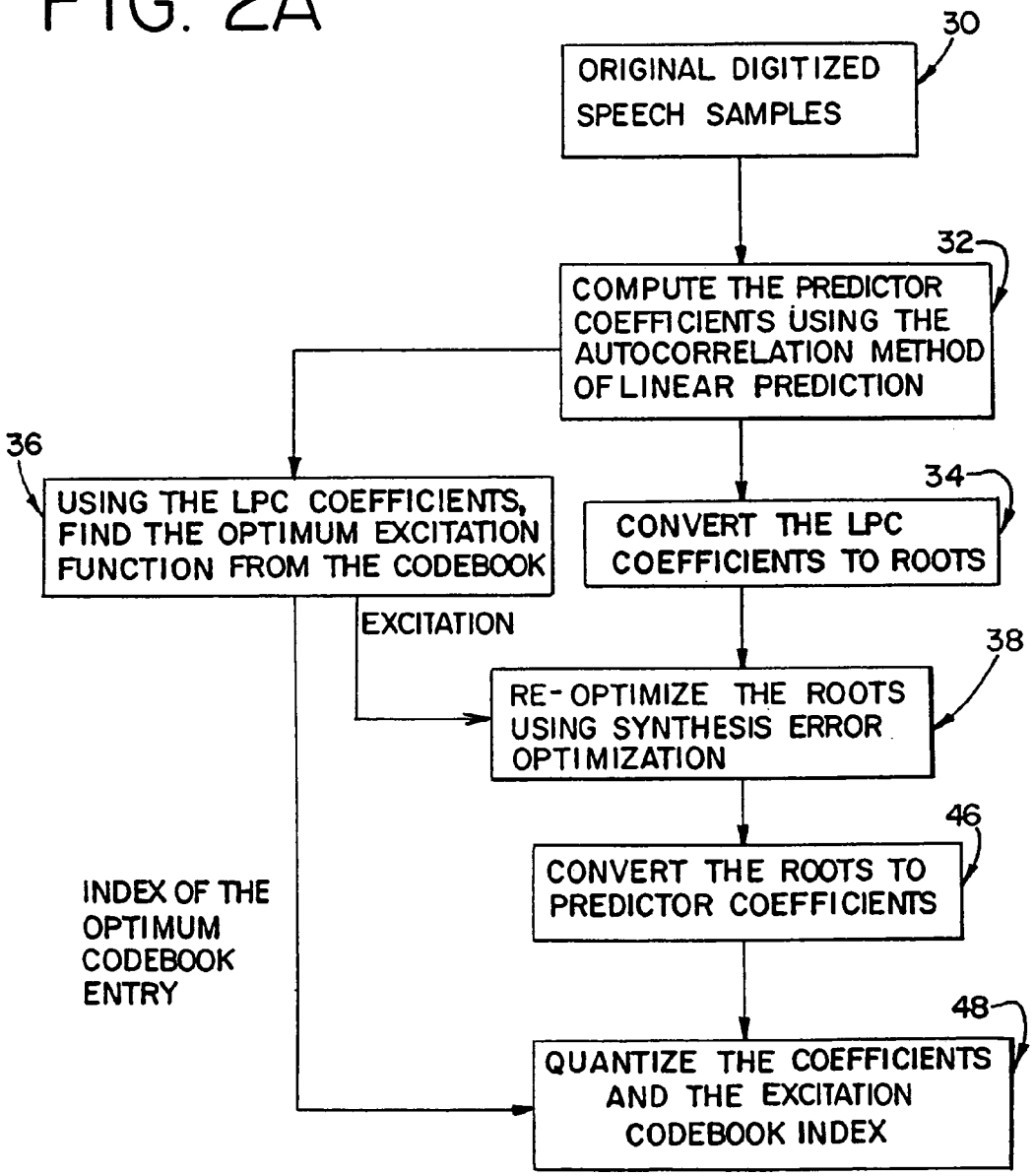
FIG. 2A is a flow chart of the speech synthesis system using model optimization only.

In FIGS. 2A and 2B, a different encoding sequence is shown that is applicable to multipulse and CELP-type speech coders which should provide even more accurate synthesis. However, some additional computing power will be needed. In this sequence, the original digitized speech sample 30 is used to compute 32 the polynomial coefficients $a_1 \ldots a_M$ using the LPC technique described above or another comparable method. The polynomial coefficients $a_1 \ldots a_M$, are then used to find 36 the optimum excitation function u(n) from a codebook. Alternatively, an individual excitation function u(n) can be found 40 from the codebook for each frame. After selection of the excitation function u(n), the polynomial coefficients $a_1 \ldots a_M$ are then also optimized. To make optimization of the coefficients $a_1 \ldots a_M$ easier, the polynomial coefficients $a_1 \ldots a_M$ are first converted 34 to the roots of the polynomial A(z). A gradient search algorithm is then used to optimize 38, 42, 44 the roots. Once the optimal roots are found, the roots are then converted 46 back to polynomial coefficients $a_1 \ldots a_M$ for compatibility with existing encoding-decoding systems. Lastly, the synthesis model and the index to the codebook entry are quantized 48 for transmission or storage.

Additional encoding sequences are also possible for improving the accuracy of the synthesis model depending on the computing capacity available for encoding. Some of these alternative sequences are demonstrated in FIG. 1 by dashed routing lines. For example, the excitation function u(n) can be reoptimized at various stages during encoding of the synthesis model.

Figure 3:
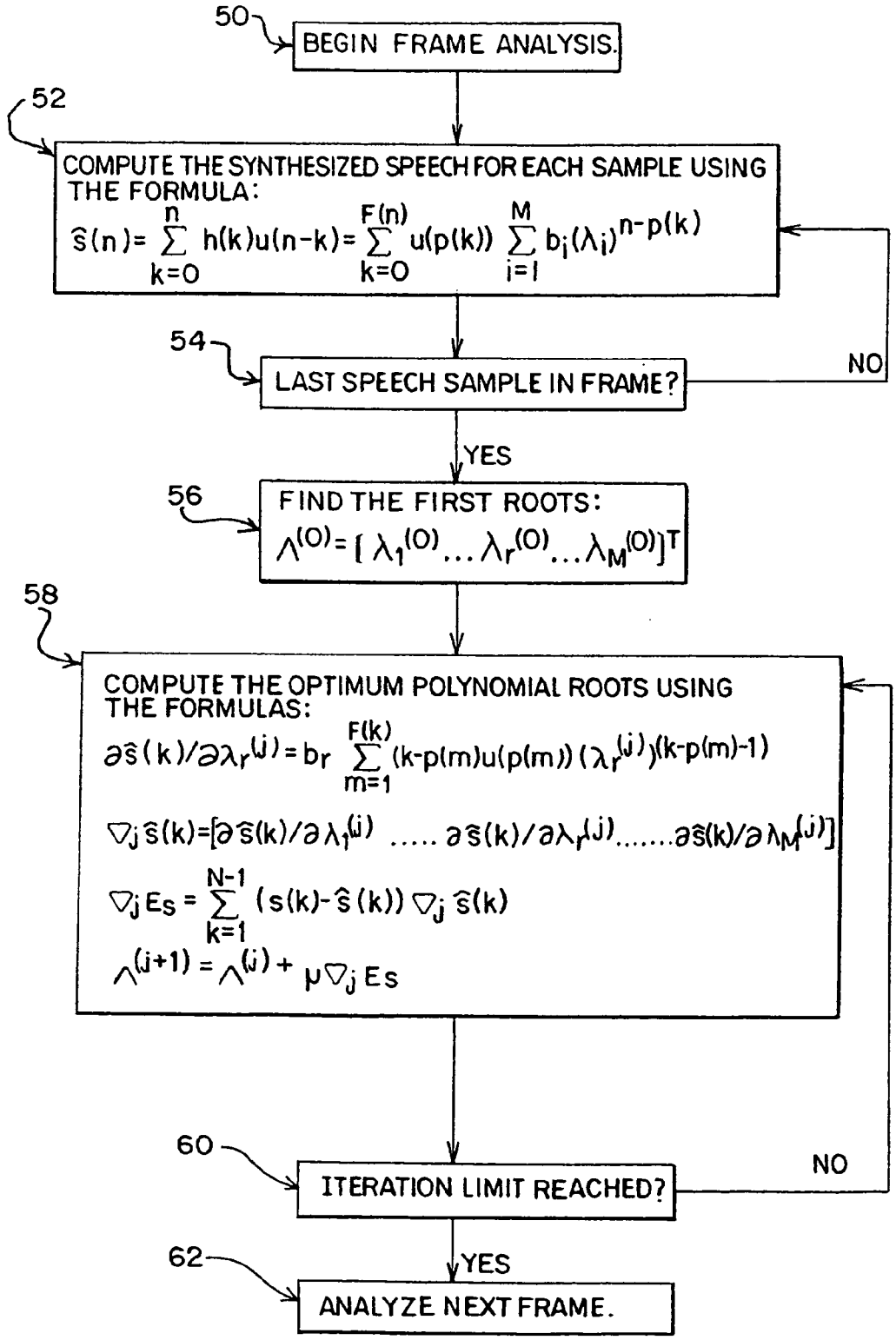
FIG. 3 is a flow chart of computations used in the efficient optimization algorithm.

FIG. 3 shows a sequence of computations that requires fewer calculations to optimize the synthesis polynominal A(z). The sequence shows the computations for one frame 50 and are repeated for each frame 62 of speech. First, the synthesized speech $\hat{s}(n)$ is computed for each sample in the frame using formula (10) 52. The computation of the synthesized speech is repeated until the last sample in the frame has been computed 54. The first roots of the synthesis filter polynomial A(z) are then computed using a standard root finding algorithm 56. Next, roots of the synthesis polynominal are optimized with an iterative gradient search algorithm using formulas (27), (25), (24) and (23) 58. The iterations are then repeated until a completion criteria is met, for example if an iteration limit is reached 60.

It is now apparent to those skilled in the art that the efficient optimization algorithm significantly reduces the number of calculations required to optimize the synthesis filter polynomial A(z). Thus, the efficiency of the encoder is greatly improved. Using previous optimization algorithms, the computation of the synthesized speech $\hat{s}(n)$ for each sample was a computationally intensive task. However, the improved optimization algorithm reduces the computational load required to compute the synthesized speech ŝ(n) by taking into account the sparse nature of the excitation pulses, thereby minimizing the number of calculations performed.

Figure 4:
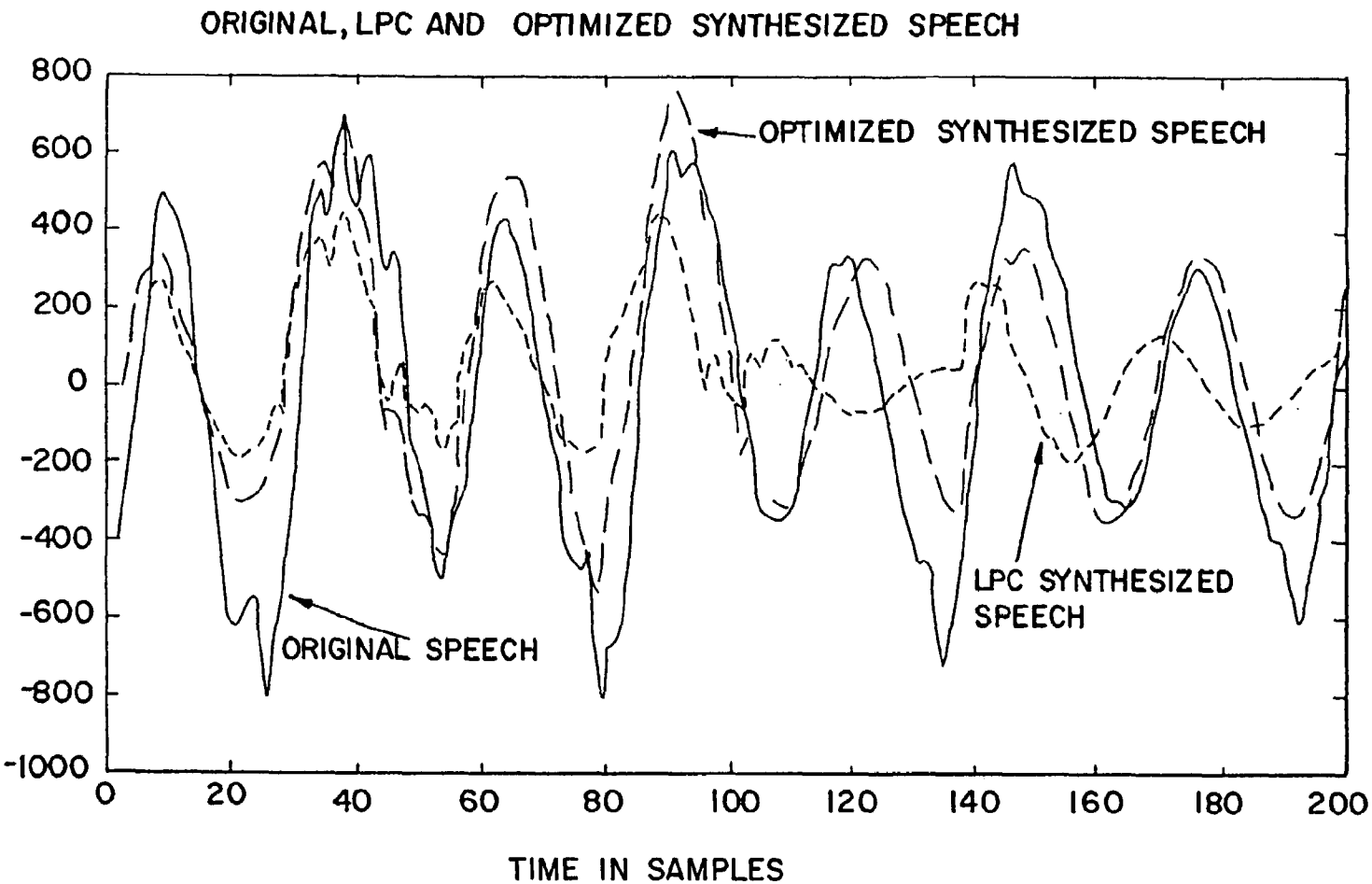
FIG. 4 is a timeline-amplitude chart, comparing an original speech sample to a multipulse LPC synthesized speech and an optimally synthesized speech.
Figure 5:
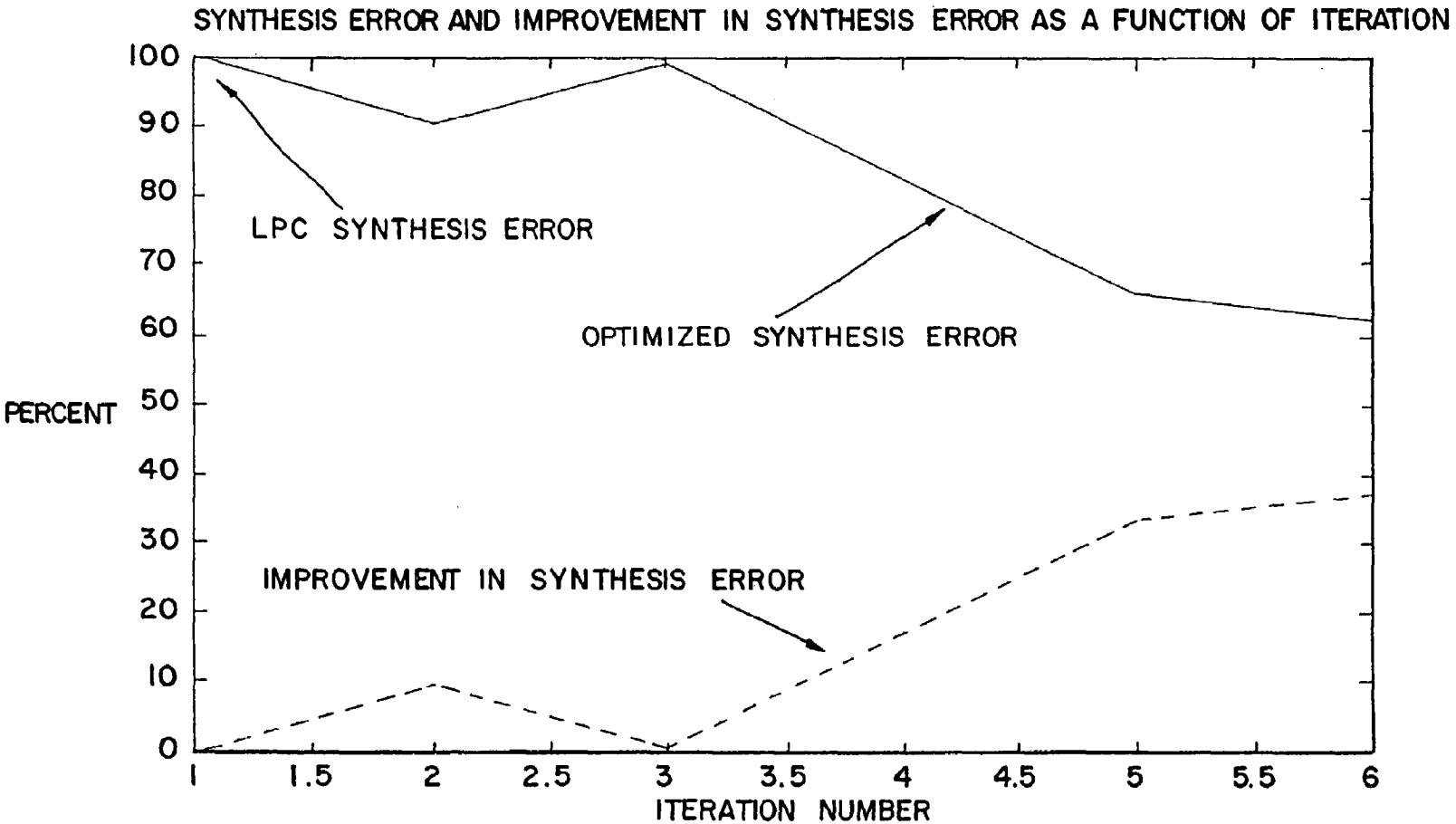
FIG. 5 is a chart, showing synthesis error reduction and improvement as a result of the optimization.
Figure 6:
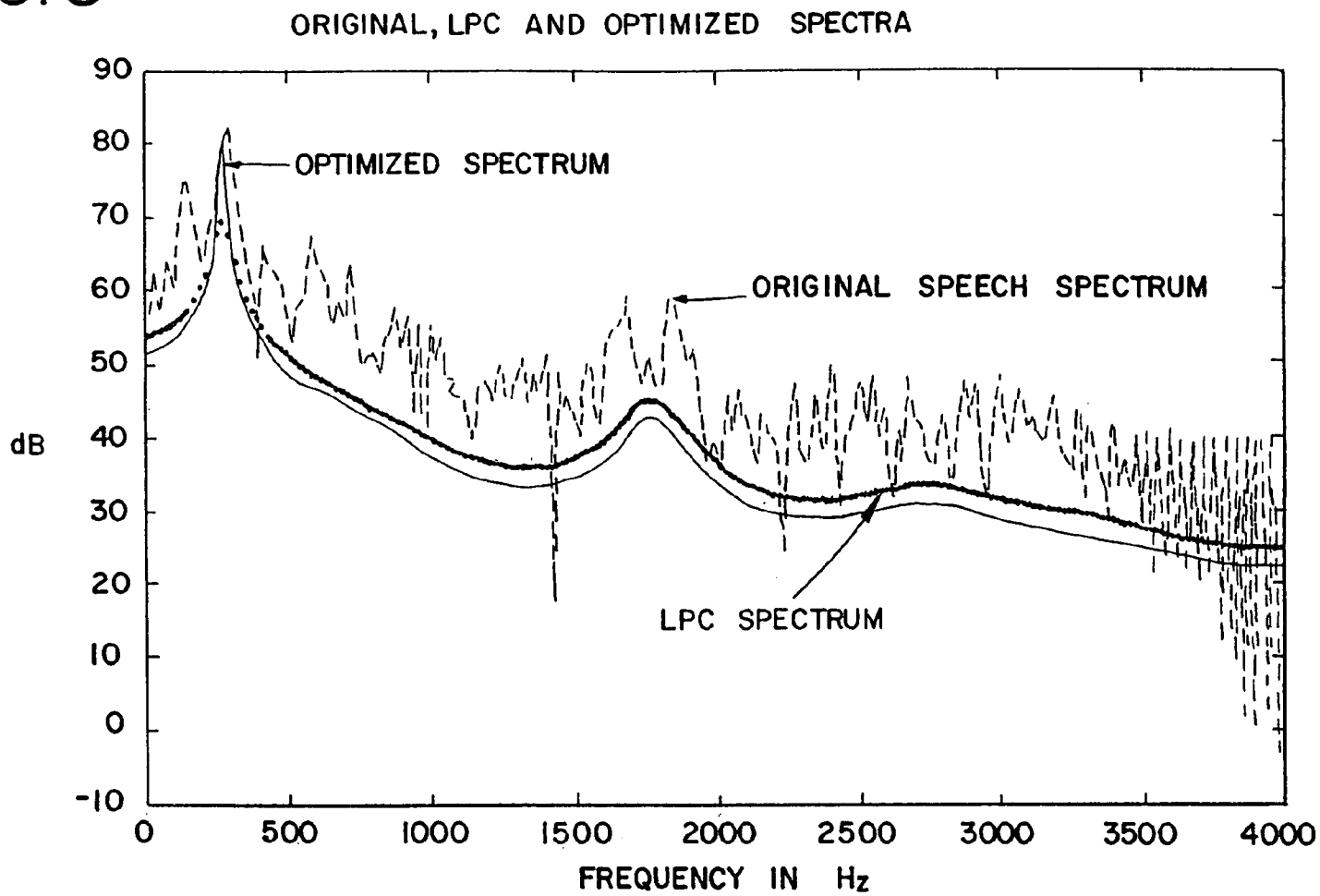
FIG. 6 is a spectral chart, comparing the spectra of the original speech sample to an LPC synthesized speech and an optimally synthesized speech.

FIGS. 4–6, show the results provided by the more efficient optimization algorithm. The figures show several different comparisons between a prior art multipulse LPC synthesis system and the optimized synthesis system. The speech sample used for this comparison is a segment of a voiced part of the nasal "m". As shown in the figures, another advantage of the improved optimization algorithm is that the quality of the speech synthesis optimization is unaffected by the reduced number of calculations. Accordingly, the optimized synthesis polynominal that is computed using the more efficient optimization algorithm is exactly the same as the optimized synthesis polynominal that would result without reducing the number of calculations. Thus, less expensive CPUs and DSPs may be used and battery life may be extended without sacrificing speech quality.

In FIG. 4, a timeline-amplitude chart of the original speech, a prior art multipulse LPC synthesized speech and the optimized synthesized speech is shown. As can be seen, the optimally synthesized speech matches the original speech much closer than the LPC synthesized speech.

In FIG. 5, the reduction in the synthesis error is shown for successive iterations of the optimization algorithm. At the first iteration, the synthesis error equals the LPC synthesis error since the LPC coefficients serve as the starting point for the optimization. Thus, the improvement in the synthesis error is zero at the first iteration. Accordingly, the synthesis error steadily decreases with each iteration. Noticeably, the synthesis error increases (and the improvement decreases) at iteration number three. This characteristic occurs when the updated roots overshoot the optimal roots. After overshooting the optimal roots, the search algorithm takes the overshoot into account in successive iterations, thereby resulting in further reductions in the synthesis error. In the example shown, the synthesis error can be seen to be reduced by 37% after six iterations. Thus, a significant improvement over the LPC synthesis error is possible with the optimization.

FIG. 6 shows a spectral chart of the original speech, the LPC synthesized speech and the optimally synthesized speech. The first spectral peak of the original speech can be seen in this chart at a frequency of about 280 Hz. Accordingly, the optimized synthesized speech waveform matches the 280 Hz component of the original speech much better than the LPC synthesized speech waveform.

While preferred embodiments of the invention have been described, it should be understood that the invention is not so limited, and modifications may be made without departing from the invention. The scope of the invention is defined by the appended claims, and all devices that come within the meaning of the claims, either literally or by equivalence, are intended to be embraced therein.

We claim:

1. A method of digitally encoding speech, comprising generating an excitation function using an excitation module, said excitation function comprising a number of non-zero pulses within an analysis frame separated by spaces therebetween;

generating synthesized speech using a synthesis filter from said number of non-zero pulses within the analysis frame without contribution from the spaces therebetween; and performing synthesis filter optimization, including selecting one of a plurality of excitation functions and selecting roots of the synthesis polynomial for one excitation function that minimizes a synthesis error produced by the synthesis filter.

2. The method according to claim 1, further comprising optimizing roots of a synthesis filter polynomial using an iterative root optimization algorithm in response to said computed synthesized speech.

3. The method according to claim 1, wherein said pulses are non-uniformly spaced.

4. The method according to claim 1, wherein said pulses are uniformly spaced.

5. The method according to claim 1, wherein said excitation function is generated using a linear prediction coding ("LPC") encoder.

6. The method according to claim 1, wherein said excitation function is generated using a multipulse encoder.

7. The method according to claim 1, wherein said spaces comprise no pulses.

8. The method according to claim 1, wherein said excitation function is generated within an analysis frame comprising a plurality of speech samples; and wherein said synthesized speech is computed in response to said samples which comprise at least one of said pulses and not in response to said samples which comprise none of said pulses.

9. The method according to claim 1, wherein said synthesized speech is calculated using the formula:

$$\hat{s}(n) = h(n) * u(n) = \sum_{k=1}^{F(n)} h(n - p(k))u(p(k)).$$

wherein ŝ(n) is the synthesized speech sample at time n, h(n) is the impulse response of the synthesis filter at time n, u(n) is the excitation function at time n, and p(k) is a location of the k-the excitation pulse in the frame.

10. The method according to claim 9, wherein said synthesized speech is further calculated using the formula:

$$\hat{s}(n) = \sum_{k=0}^{n} h(k)u(n-k) = \sum_{k=1}^{F(n)} u(p(k)) \sum_{i=1}^{M} (b_i(\lambda_i))^{n-p(k)}$$

where $b_i$ is the i-th decomposition coefficient; and where said excitation function is defined by the formulas:

$$u(p(k)) \neq 0 \text{ for } k=1,2 \ldots N_p$$

$$u(n)=0 \text{ for } n \neq p(k)$$

and where F(n) is a number of excitation pulses in an analysis frame up to sample n and is defined by the formulas:

$$p(F(n)) \leq n$$

$$F(n) \leq N_p,$$

where $N_p$ is the number of excitation pulses in the analysis frame.

11. The method according to claim 10, further comprising computing roots of a synthesis filter polynomial using the formula:

$$\partial\hat{s}(k)/\partial\lambda_r^{(j)} = b_r\sum_{m=1}^{F(k)}(k-p(m))u(p(m))(\lambda_r^{(j)})^{(k-p(m)-1)}.$$

where $\lambda_r^{(j)}$ is the r-th root of the synthesis filters at the j-th iteration, and $\partial\hat{s}(k)/\partial\lambda_r^{(j)}$ is the partial derivative of the k-th synthesized speech sample relative to the r-th root of the synthesis filter at the j-th iteration.

12. The method according to claim 1, wherein said synthesized speech computation comprises calculating a convolution of an impulse response and said excitation function; and wherein said spaces comprise no pulses.

13. The method according to claim 12, wherein said excitation function is generated within an analysis frame comprising a plurality of speech samples; wherein said synthesized speech is computed in response to said samples which comprise at least one of said pulses and is not computed in response to said samples which comprise none of said pulses; and wherein said synthesized speech is calculated using the formula:

$$\hat{s}(n) = h(n)*u(n) = \sum_{k=1}^{F(n)} h(n-p(k))u(p(k)).$$

wherein $\hat{s}(n)$ is the synthesized speech sample at time n, h(n) is the impulse response of the synthesis filter at time n, u(n) is the excitation function at time n, and p(k) is a location of the k-th excitation pulse in the frame.

14. The method according to claim 13, wherein said pulses are non-uniformly spaced; and wherein said excitation function is generated using a multipulse encoder.

15. The method according to claim 14, further comprising optimizing roots of a synthesis polynomial using an iterative root searching algorithm in response to said computed synthesized speech.

16. A method of digitally encoding speech, comprising producing a series of pulses within an analysis frame, adjacent pulses defining a space therebetween; and generating a synthesis polynomial, said generating the synthesis polynomial comprising calculating a contribution of said pulses and not calculating a contribution of only said space, and including selecting one of a plurality of excitation functions and selecting roots of the synthesis polynomial for the one excitation function that minimizes a synthesis error produced by the synthesis filter.

17. The method according to claim 16, wherein said synthesis filter polynomial computation comprises calculating a convolution of an impulse response and said excitation function; wherein said excitation function is generated within an analysis frame comprising a plurality of speech samples; and wherein said synthesis filter polynomial is computed in response to said samples which comprise at least one of said pulses and is not computed in response to said samples which comprise none of said pulses; and further comprising optimizing roots of said synthesis filter polynomial using an iterative root optimization algorithm.

18. The method according to claim 17, wherein said synthesis filter polynomial is calculated using the formula:

$$\hat{s}(n) = h(n)*u(n) = \sum_{k=1}^{F(n)} h(n-p(k))u(p(k))$$

wherein $\hat{s}(n)$ is the synthesized speech sample at time n, h(n) is the impulse response of the synthesis filter at time n, u(n) is the excitation function at time n, and p(k) is a location of the k-th excitation pulse in the frame; and where said excitation function is defined by the formulas:

$$u(p(k))\neq 0 \text{ for } k=1,2\ldots N_p$$

$$u(n)=0 \text{ for } n\neq p(k)$$

and where F(n) is a number of excitation pulses in an analysis frame up to sample n and is defined by the formulas:

$$p(F(n))\leqq n$$

$$F(n)\leqq N_p,$$

where $N_p$ is the number of excitation pulses in the analysis frame.

19. A speech synthesis system, comprising an excitation module responsive to an original speech and generating an excitation function using an excitation module, said excitation function comprising a series of pulses within an analysis frame; and a synthesis filter responsive to said excitation function and said original speech and generating a synthesized speech using a synthesis filter; wherein said synthesis filter computes a convolution of an impulse response and said excitation function, said convolution computation comprising calculating samples of speech having only said pulses within the analysis frame; including selecting one of a plurality of excitation functions and selecting roots of the synthesis polynomial for the one excitation function that minimizes a synthesis error produced by the synthesis filter.

20. The method according to claim 19, wherein said synthesis filter computes roots of a synthesis polynomial using the formula:

$$\frac{\partial\hat{s}(k)}{\partial\lambda_r^{(j)}} = b_r\sum_{m=1}^{F(k)}(k-p(m))u(p(m))(\lambda_r^{(j)})^{(k-p(m)-1)}.$$

where $\lambda_r$ is the r-th root at the synthesis filter, at the j-th iteration, and $\partial\hat{s}(k)/\partial\lambda_r^{(j)}$ is the partial derivative of the k-th synthesized speech sample relative to the r-th root of the synthesis filter at the j-th iteration, where p(m) is a location of the m-th excitation pulse, u(p(m)) is an excitation function at time p(m), and k is a time index.

21. The method according to claim 19, wherein said convolution computation is calculated using the formula:

$$\hat{s}(n) = \sum_{k=0}^{n} h(k)u(n-k) = \sum_{k=1}^{F(n)} u(p(k))\sum_{i=1}^{M}(b_i(\lambda_i))^{n-p(k)}$$

where $\lambda_r$ is the r-th root at the synthesis filter p(k) is a location of the m-th excitation pulse, u(p(k)) is an excitation function at time p(k), and k is a time index, and where said excitation function is defined by the formulas:

$$u(p(k))\neq 0 \text{ for } k=1,2 \ldots N_p$$

$$u(n)=0 \text{ for } n\neq p(k)$$

and where F(n) is a number of excitation pulses in an analysis frame up to sample n and is defined by the formulas:

$$p(F(n))\leqq n$$

$$F(n)\leqq N_p,$$

where $N_p$ is the number of excitation pulses in the analysis frame.

22. The method according to claim 19, wherein said convolution computation is calculated using the formula:

$$\hat{s}(n) = h(n) * u(n) = \sum_{k=1}^{F(n)} h(n - p(k))u(p(k))$$

wherein ŝ(n) is the synthesized speech sample at time n, h(n) is the impulse response of the synthesis filter at time n, u(n) is the excitation function at time n, and p(k) is a location of the k-th excitation pulse in the frame; and where said excitation function is defined by the formulas:

$$u(p(k))\neq 0 \text{ for } k=1,2 \ldots N_p$$

$$u(n)=0 \text{ for } n\neq p(k)$$

and where F(n) is a number of excitation pulses in an analysis frame up to sample n and is defined by the formulas:

$$p(F(n))\leqq n$$

$$F(n)\leqq N_p,$$

where $N_p$ is the number of excitation pulses in the analysis frame.

23. The method according to claim 22, wherein said pulses are non-uniformly spaced.

24. The method according to claim 22, wherein said pulses are uniformly spaced; and wherein said excitation function is generated using a linear predictive coding ("LPC") encoder.

25. The method according to claim 22, further comprising a synthesis filter optimizer responsive to said excitation function and said synthesis filter and generating an optimized synthesized speech sample; wherein said synthesis filter optimizer minimizes a synthesis error between said original speech and said synthesized speech; wherein said synthesis filter optimizer comprises an iterative root optimization algorithm; and wherein said iterative root optimization algorithm uses the formula:

$$\frac{\partial \hat{s}(k)}{\partial \lambda_r^{(j)}} = b_r \sum_{m=1}^{F(k)} (k - p(m))u(p(m))(\lambda_r^{(j)})^{(k-p(m)-1)}.$$

where $\lambda_r^{(j)}$ is the r-th root of the synthesis filter at the j-th iteration, and $\partial\hat{s}(k)/\partial\lambda_r^{(j)}$ is the partial derivative of the k-th synthesized speech sample relative to the r-th root of the synthesis filter at the j-th iteration.

* * * * *